United States Patent [19]

Huestis

[11] 4,178,151

[45] Dec. 11, 1979

[54] APPARATUS FOR MONITORING THE FEEDING OF PARTICULATE MATERIALS TO A PACKED BED FURNACE

[75] Inventor: Allan C. Huestis, Georgetown, S.C.

[73] Assignee: Midrex Corporation, Charlotte, N.C.

[21] Appl. No.: 883,435

[22] Filed: Mar. 2, 1978

[51] Int. Cl.[2] ..... F27B 1/00; F27B 1/10

[52] U.S. Cl. ..... 432/1; 432/36; 432/95

[58] Field of Search ..... 432/36, 95, 1; 73/15 R, 73/15 FD

[56] References Cited

U.S. PATENT DOCUMENTS 2,444,274 6/1948 Utterback ..... 432/36

FOREIGN PATENT DOCUMENTS 1583443 1/1972 Fed. Rep. of Germany ..... 432/36

*Primary Examiner*—John J. Camby

*Attorney, Agent, or Firm*—Ralph H. Dougherty

[57] ABSTRACT

Apparatus for monitoring the feeding of particulate materials into a packed bed furnace such as a shaft furnace by locating thermowells each containing a thermocouple at the wall of the furnace, preferaby recessed therein, beneath the normal stockline of the furnace. The thermocouple determines the presence of feed material and in the absence of such material a signal is generated which may be an alarm.

10 Claims, 5 Drawing Figures

FIG. 2.
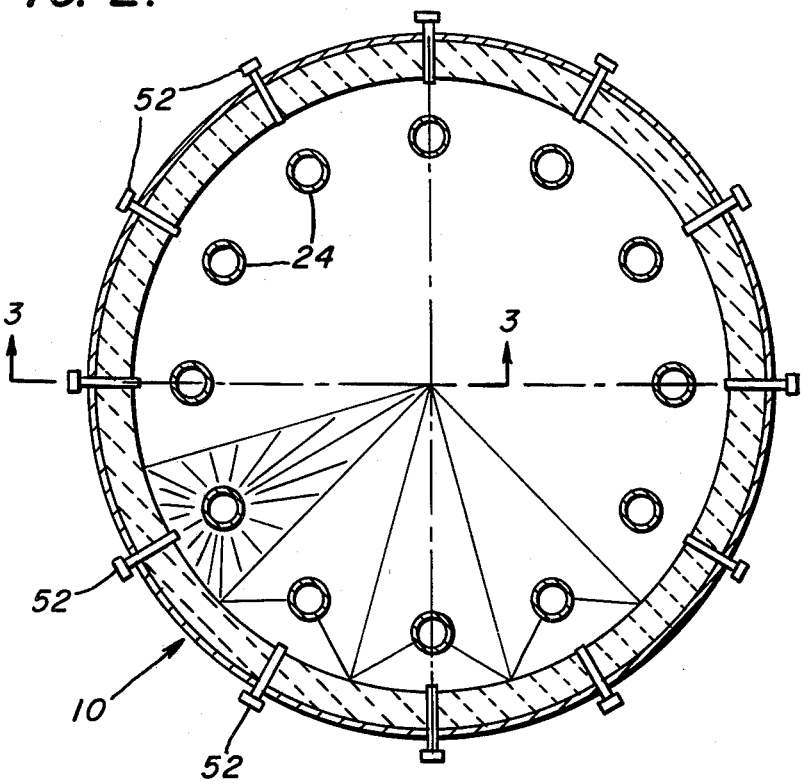
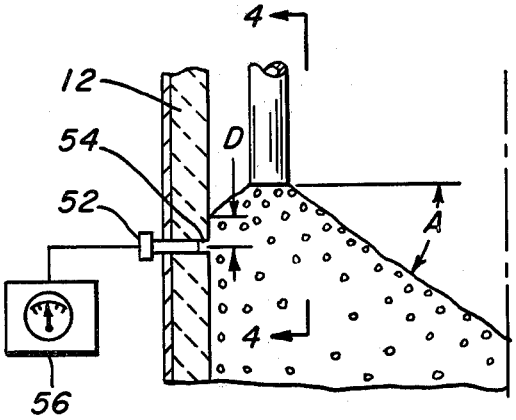
FIG. 3.
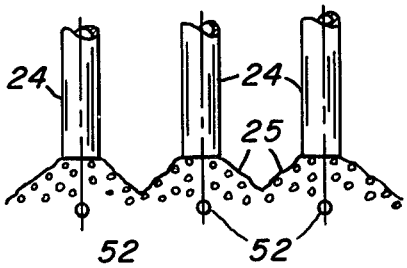
FIG. 4.
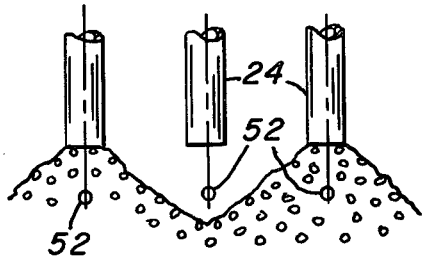
FIG. 5.

APPARATUS FOR MONITORING THE FEEDING OF PARTICULATE MATERIALS TO A PACKED BED FURNACE

BACKGROUND OF THE INVENTION

This application relates generally to vertical shaft-type furnaces and more particularly to apparatus for feeding solid particulates therein. This invention is particularly applicable for feeder arrangements for vertical shaft furnaces used in the direct reduction of iron ore wherein pelletized, lump, or sized iron ore mixed with fines constitutes the feed material. It will be appreciated by those skilled in the art that the invention has other applications and may be applied to any vertical furnace charged with particulate solids and heated gas for treating such solids which is passed in counter-flow relationship through a descending burden.

In vertical shaft furnaces for the direct reduction of iron ore, pellets, fines, lumps, etc. or a mixture thereof are charged to a shaft furnace through a hopper arrangement which feeds a number of charge tubes or feed legs, the lower ends of which terminate within the furnace near the external wall. The charge material forms a packed bed, or burden, in the furnace.

In accordance with the subject invention, a thermocouple is provided in the furnace wall to sense the temperature in the wall of the furnace near the stock line. The temperature rises or is high when the thermocouple is submerged in hot particulate material which entered the furnace through a feed leg tube, then became heated by the hot gases. Because of the excellent heat transfer in the packed bed between the hot gas and the burden, and the relatively high flow of reducing gas required in direct reduction relative to burden flow, the particulate material becomes heated to a temperature approaching the hot gas inlet temperature just a few inches (3 to 6 ) below the stock line. The pellets at the stock line have not yet become heated. When the temperature of the thermocouple increases, this indicates that no pellets are in its vicinity, that is, the stock line has dropped because its associated feed tube is plugged.

It is thus the principal object of this invention to provide a method and apparatus for detecting plugged feed legs in a shaft furnace.

The invention is more readily understood by referring to the following detailed description and the accompanying drawings in which:

FIG. 2 is a horizontal section of the furnace taken through the line 2—2 of FIG. 1.

FIG. 3 is a partial vertical cross-section of the furnace taken along line 3—3 of FIG. 2.

FIG. 4 is an elevational view within the furnace taken along line 4—4 of FIG. 3.

FIG. 5 is a view within the furnace similar to FIG. 4 but with a plugged feed tube.

DETAILED DESCRIPTION

Figure 1:
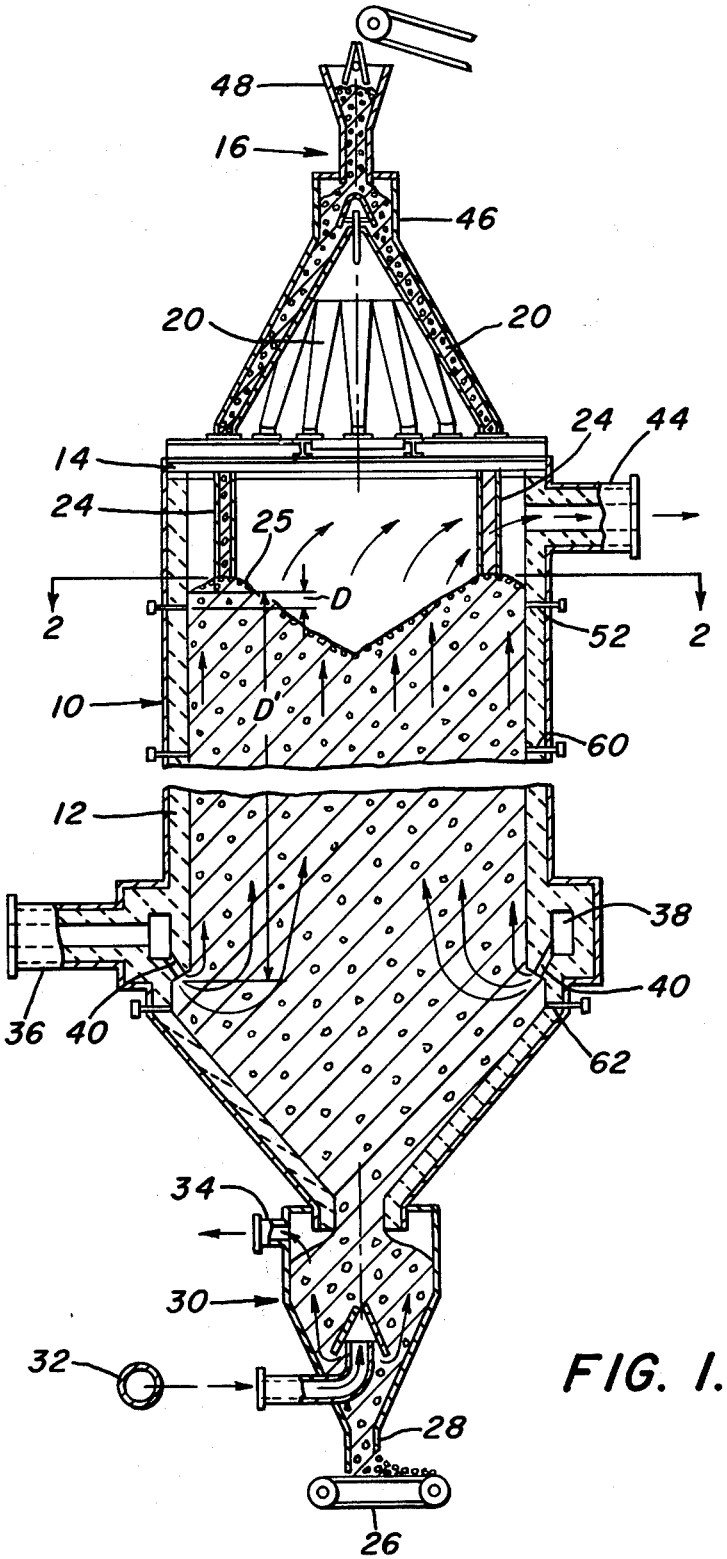
FIG. 1 is a sectional elevational view of a vertical shaft-type furnace with associated feed apparatus.

Referring now to the drawings which illustrate a preferred embodiment of the invention, FIG. 1 shows a vertical shaft furnace 10 lined with refractory material 12 and having an upper furnace cover 14 atop which is located a feed apparatus 16 which feeds a plurality of discharge tubes 20 equally spaced about the circumference of the furnace top, each of which tube 20 connects with a generally vertical discharge leg 24 terminating within the shaft furnace 10. Particulate material is fed through the hopper and discharge tubes or feed tubes 24 to the interior of the furnace to form a burden therein having a stock line 25 inclined downwardly from the bottom of each tube at approximately the normal angle of repose, angle A, of said particulate material which is about 35° as shown in FIG. 3.

A product removal apparatus such as a belt feeder 26 withdraws product from the bottom of the furnace through discharge pipe 28 thus establishing a gravitational flow of material through the furnace.

A cooler 30 may be provided to reduce the temperature of the burden by introducing a non-oxidizing cooling gas from a source 32 and withdrawing cooling gas from the cooler as spent gas through take-off pipe 34.

All reducing gas is delivered through inlet pipe 36 to a gas distribution bustle 38 extending peripherally about the external wall of the shaft furnace and communicating with the interior of the shaft furnace by a series of ports 40. The reducing gas introduced through ports 40 moves radially inwardly across the burden then flows upwardly in counterflow relationship to the descending burden. Reacted reducing gas exits from the burden at stock line 25 in the upper portion of the furnace, then moves to a take-off pipe 44 adjacent to the top end of shaft furnace 10, through which the spent gas is removed.

Feed apparatus mounted at top of shaft furnace 10 may comprise a proportioning hopper 46 which feeds the plurality of discharge tubes 20. Feed material is fed into the proportioning hopper from a charge bin 48.

Feed tubes 24 communicate with tubes 20 and extend in a predetermined pattern into the body of shaft furnace 10 through the top 14 thereof. Thermocouples 52 are located in the furnace sidewall a distance D, about 10 to about 40 cm, but preferably 15 to 35 cm, below the intersection of the stock line 25 with the refractory lining of the wall. The distance D should be no more than one-sixth the distance D', which is the vertical distance between the normal stock line and the reducing gas inlet. Each thermocouple 52 is radially spaced from its associated feed tube 24. In order to prevent wear, the thermocouples may be situated in a wall recess 54. The thermocouples are connected to a read-out apparatus 56 as shown in FIG. 3, or to a recorder or print-out device. Alternatively, either the thermocouple or read-out device can be connected to an alarm signal to alert an operator to potential trouble.

The thermocouples 52 are spaced about the furnace in an annular array as shown in FIG. 2. A second ring of thermocouples 60 is situated midway between the first ring of thermocouples 52 and the gas inlet port 40 to continuously monitor the temperature of the burden within the reducing zone. This provides a control for the operator to compare against the temperatures displayed by thermocouples 52. A third ring of thermocouples 62 is situated in the furnace wall beneath the reducing gas inlet ports 40 to monitor the temperature of the burden at the reducing gas inlet. This temperature normally is slightly higher than the readings of the two upper rings of thermocouples.

When hot reducing gas is introduced into the interior of the furnace through bustle gas ports 40 at a temperaure of from 700°-900° C. (about 1300°-1650° F.), the hot reducing gas both heats the particulate burden and reduces the particulate iron oxide to about 85 to 96 percent metallized iron. The heated burden maintains a temperature usually in excess of 700° C. at all elevations up to about 30 to 50 cm below the elevation of the stock line. The pellets at the stock line are cold, but they are hot about 30 to 50 cm beneath the stock line. Thus, when the stock line is maintaining its normal elevation, and the feed system is operating normally without any plugging of feed tubes, the thermocouples are all submerged in the burden and read about the same temperature, roughly about 490° to 760° C. (900° to 1400° F.). When a feed tube is blocked, the burden in the region beneath that blocked feed tube continues to move downward gravitationally, but no additional material is fed into that region, thus the thermocouple associated with the blocked feed tube becomes exposed to the gas stream. The exit temperature of top gas exiting the stock line in the furnace is in the range of 250°–350° C. (480°–660° F.). When a feed pipe is plugged, a deep valley immediately is formed as shown in FIG. 5. The gas exiting the stock line from the deep valley is considerably hotter than the gas exiting the stock line near other feed pipes as it has passed through less material. Thus, when a feed pipe is plugged, the associated thermocouple senses a drastic increase in temperature.

Since each thermocouple is connected to an individual read-out, the operator can readily tell which feed tube is plugged because its associated thermocouple will have detected a much higher temperature than the temperature of the thermocouple associated with those tubes which are not plugged or the temperature of the burden as indicated by a lower ring of thermocouples.

When extremely cold material is being fed into the burden, the temperaure reading of a thermocouple associated with a plugged feed tube may drop before it rises. Thus a temperature change in either direction indicates a blocked feed tube.

The equipment required to detect plugged feed pipes in accordance with the present invention is very inexpensive. In addition, an operator can respond very quickly as there is an almost instantaneous response to the temperature changes in the thermowell.

It is clear from the foregoing that this invention provides a simple method and apparatus for detecting plugged feed legs in a direct reduction furnace wherein a particulate burden of oxide feed material continuously descends therethrough by force of gravity and is continuously reduced by a counterflow of hot gas through the burden.

What is claimed is:

1. In a vertical shaft-type furnace for the heat treatment of solid particles, said furnace having an upstanding wall, at least one downwardly extending feed tube in the upper portion of said furnace to deliver solid particles to the interior of said furnace and form a burden therein having a stock-line at the top thereof, means for removing treated particles from the bottom of said furnace to establish a continuous gravitational flow of said burden, a hot treating gas inlet intermediate the ends of the furnace below the stock-line, and a gas outlet above the elevation of the burden stock-line, the improvement comprising a thermocouple in the furnace wall opposite such feed tube, said thermocouple being located vertically between said stock-line and one-sixth the vertical distance between the stock-line and the hot treating gas inlet, said thermocouple being connected to a temperature indicating device.

2. Apparatus according to claim 1 wherein the furnace wall is provided with a recess for said thermocouple and said thermocouple is situated in said recess to prevent wear.

3. Apparatus according to claim 1 wherein said temperature indicating device is accessible to an operator.

4. Apparatus according to claim 1 wherein said temperature indicating device permanently records the temperature indicated.

5. Apparatus according to claim 1 wherein said temperature indicating device is connected to an alarm signal.

6. Apparatus according to claim 1 wherein said vertical shaft-type furnace is a reducing furnace for the gaseous reduction of solid metal oxide particles.

7. Apparatus according to claim 6 wherein said solid metal oxide particles are iron oxide.

8. Apparatus according to claim 1 wherein said shaft furnace has a plurality feed tubes, each provided with an associated thermocouple.

9. A method of detecting a blocked feed tube in a generally vertical direct reduction furnace in which said furnace has a plurality of feed tubes for charging particulate metal oxide material into the top of said furnace to establish a particulate metal oxide burden therein, means for removing metallized particles from the bottom thereof to establish a continuous gravitational flow of the burden through said furnace, and means for establishing a counter-current flow of hot reducing gas through said burden, said method comprising:

(a) continuously monitoring the temperature of the burden in the region of each feed tube:

(b) continuously comparing the temperatures so monitored; and (c) whereby a significant temperature change indicates that the feed tube has become blocked.

10. A method according to claim 9 further comprising continuously monitoring the temperature of the burden at a selected location beneath the region of the feed tube and comparing that temperature with the temperature of the burden in the region of the feed tube, whereby a significant variation between the two temperatures indicates that a feed tube is blocked.

* * * * *